US006679435B1

(12) United States Patent
Noller et al.

(10) Patent No.: US 6,679,435 B1
(45) Date of Patent: Jan. 20, 2004

(54) FUEL INJECTOR

(75) Inventors: Klaus Noller, Oppenweiler (DE); Peter Asslaender, Grand Rapids, MI (US); Hubert Stier, Asperg (DE); Hans Weldler, Pettstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/623,818

(22) PCT Filed: Oct. 1, 1999

(86) PCT No.: PCT/DE99/03157

§ 371 (c)(1),
(2), (4) Date: Dec. 15, 2000

(87) PCT Pub. No.: WO00/40855

PCT Pub. Date: Jul. 13, 2000

(30) Foreign Application Priority Data

Jan. 8, 1999 (DE) ..... 199 00 406

(51) Int. Cl.[7] ..... F02D 1/06

(52) U.S. Cl. ..... 239/5; 239/585.4; 239/600; 239/900; 251/129.21; 29/890.143

(58) Field of Search ..... 239/585.1, 585.4, 239/585.5, 900, 600, 5; 251/129.15, 129.21; 29/890.142, 890.143

(56) References Cited

U.S. PATENT DOCUMENTS

| | | | | |
|---|---|---|---|---|
| 4,946,107 A | | 8/1990 | Hunt | |
| 5,301,874 A | * | 4/1994 | Vogt et al. | 239/585.4 |
| 5,433,386 A | | 7/1995 | Wieczorek et al. | |
| 5,996,910 A | * | 12/1999 | Takeda et al. | 239/585.1 |

FOREIGN PATENT DOCUMENTS

| | | |
|---|---|---|
| DE | 41 08 665 | 11/1991 |
| DE | 195 47 406 | 6/1997 |
| DE | 197 12 590 | 10/1998 |

* cited by examiner

*Primary Examiner*—Steven J. Ganey
(74) *Attorney, Agent, or Firm*—Kenyon & Kenyon

(57) ABSTRACT

A fuel injector for fuel injection systems of internal combustion engines has an electromagnetic actuating element including a magnet coil, a tubular internal pole and an external magnetic circuit part, a valve sleeve having an internal opening and thin walls and a movable valve closing body which works together with a valve seat assigned to a valve seating body. The valve seating body and the internal pole are fixedly arranged in the internal opening in the valve sleeve . The internal pole has a longitudinal slot formed by producing it by rolling and/or bending.

9 Claims, 2 Drawing Sheets

FUEL INJECTOR

FIELD OF THE INVENTION

The present invention relates to a fuel injector.

BACKGROUND INFORMATION

U.S. Pat. No. 4,946,107 describes an electromagnetically operable fuel injector having, inter alia, a nonmagnetic sleeve as the connecting part between a core and a valve seating body. With its two axial ends, the sleeve is fixedly connected to the core and to the valve seating body. The sleeve runs over its entire axial length with a constant outside diameter and a constant inside diameter and accordingly has equally large inlet openings at both ends. The core and the valve seating body are designed with an outside diameter such that they extend into the sleeve at both ends so that the sleeve completely surrounds both parts, the core and the valve seating body, in areas projecting into them. A valve needle with an armature that is guided through the sleeve moves inside the sleeve. The fixed connections of the sleeve to the core and the valve seating body are achieved by welding, for example. The volume and the weight of the fuel injector can be reduced with the help of the tubular sleeve.

Unexamined German Patent No. 195 47 406 describes a fuel injector having an elongated, thin-walled, nonmagnetic sleeve which also has a bottom section in addition to its jacket section. The bottom section runs largely perpendicular to the otherwise axial extent of the sleeve along the longitudinal axis of the valve. A valve needle can move axially in a through-hole in the sleeve. A valve closing body fixedly connected to the valve needle works together with a valve seat face provided on a valve seating body, with the valve seating body pressed in the sleeve in direct or indirect contact with a bottom section of the sleeve by means of a perforated disk. In addition to the axially movable valve needle and the valve seating body, a tubular core designed as a rotating part which functions as an internal pole is arranged in the through-hole of the sleeve. The core is fixedly connected to the sleeve by welding in a desired position. A similar arrangement of a tubular core in a valve sleeve is also described in Unexamined German Patent No. 197 42 590.

Such magnetic cores which function as an internal pole for fuel injectors are usually produced by metal cutting methods, the conventional methods of producing these magnetic cores including turning, milling, drilling and precision working procedures.

SUMMARY

A fuel injector according to the present invention has the advantage that it can be produced and installed very easily. Rolling and bending are comparatively simple and inexpensive manufacturing methods with a relatively low cost for materials.

The internal pole is manufactured from a simple metal strip in an advantageous manner. A longitudinal slot running axially on the internal pole is obtained by rolling this strip, yielding a further reduction in eddy currents and thus a greater efficiency of the magnetic circuit.

In addition, assembly of the internal pole in the valve sleeve and the stroke setting are greatly simplified with the help of the internal pole. From the beginning, the internal pole is under a radial bias after rolling and bending, allowing the internal pole to be secured easily in the valve sleeve. In addition, the radial size of the internal pole can be varied slightly due to its longitudinal slot, so that burrs are prevented from developing when the internal pole is pushed into the valve sleeve in an advantageous manner.

It is similarly easy to push the internal pole with an adjusting tool for setting the stroke of a valve needle in the valve sleeve. Therefore, the valve sleeve advantageously has a shoulder near the internal pole so that the adjusting tool can act on this shoulder just as on the internal pole.

In this way, a frictional connection can be established between the valve sleeve and the internal pole.

DETAILED DESCRIPTION

Description of the Embodiment

Figure 1:
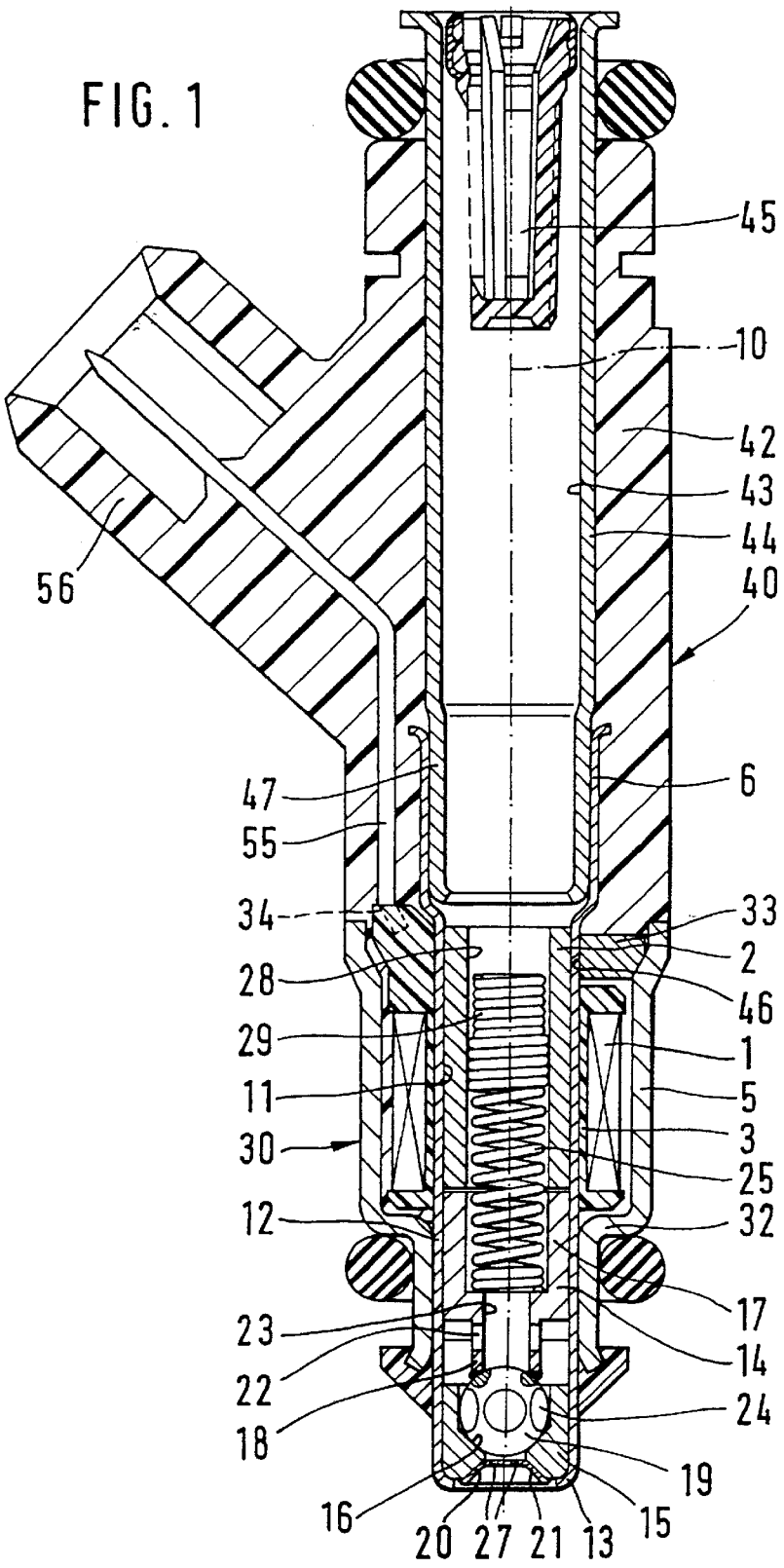
FIG. 1 shows a fuel injector having an internal pole according to an example embodiment of the present invention.

The electromagnetically operable valve according to the present invention, illustrated in FIG. 1 as an example, in the form of an injection valve for fuel injection systems of internal combustion engines having applied ignition of a compressed mixture has a tubular core 2 surrounded by a magnet coil 1 which functions as the internal pole and in part as a fuel flow passage. Magnet coil 1 is completely surrounded in the peripheral direction by an outer sleeve-shaped valve jacket 5 which is designed with steps and may be ferromagnetic, for example. This magnet coil functions as an external pole or an external magnetic circuit part. Magnet coil 1, core 2 and valve jacket 5 together form an actuating element that can be energized electrically.

While magnet coil 1 embedded in a coil body 3 surrounds a valve sleeve 6 on the outside, core 2 is inserted into an internal opening 11 in valve sleeve 6 running concentrically with a longitudinal axis 10 of the valve. Valve sleeve 6 may be ferritic, for example, and has an elongated design with thin walls, a jacket section 12 and a bottom section 13. Jacket section 12 borders opening 11 in the peripheral direction and bottom section 13 borders this opening in the axial direction at its downstream end. Opening 11 also functions as a guide opening for a valve needle 14 which is axially movable along longitudinal axis 10 of the valve.

In addition to core 2 and valve needle 14, a valve seating body 15 is also arranged in opening 11 and sits on bottom section 13 of valve sleeve 6 and has a fixed valve seat face 16 as the valve seat. Valve needle 14 is formed, for example, by a tubular armature section 17, a needle section 18 which is also tubular and a spherical valve closing body 19, with valve closing body 19 being fixedly connected to needle section 18 by a weld, for example. A flat spray perforated disk 21 is arranged on the downstream end of valve seating body 15, e.g., in a recess 20 in the form of a truncated cone, with the fixed connection between valve seating body 15 and spray perforated disk 21 being formed by a tight peripheral weld, for example. One or more transverse openings 22 are provided in needle section 18 of valve needle 14, so that fuel flowing through armature section 17 in an internal longitudinal bore 23 can escape to the outside and can flow along valve closing body 19, e.g., on flat surfaces 24, toward valve seat face 16.

This fuel injector is operated electromagnetically in a conventional way. The electromagnetic circuit having magnet coil 1, internal core 2, outer valve jacket 5 and armature section 17 functions to provide the axial movement of valve needle 14 and thus to open the injection valve against the spring force of a restoring spring 25 acting on valve needle 14 and to close the injection valve. Armature section 17 is aligned with core 2 with the end facing away from valve closing body 19.

Spherical valve closing body 19 acts together with valve seat face 16 of valve seating body 15 tapering in the form of a truncated cone in the direction of flow; valve seat face 16 is designed downstream from a guide opening in valve seating body 15 in the axial direction. Spray perforated disk 21 has at least one, e.g., four, spray openings 27 formed by erosion, laser cutting or punching.

The depth of penetration of core 2 in the injection valve also determines the stroke of valve needle 14. An end position of valve needle 14 when magnet coil 1 is not energized is determined by the contact of valve closing body 19 with valve seat face 16 of valve seating body 15, while the other end position of valve needle 14 when magnet coil 1 is energized is determined by the contact of armature section 17 with the downstream core end. The stroke is adjusted by an axial displacement of core 2 in valve sleeve 6, which is fixedly connected to valve sleeve 6 according to the desired position. Core 2 has a slight excess with respect to the inside diameter of valve sleeve 6. The fixation of core 2 and thus the adjustment of the stroke of the valve needle are then preferably self-locking functions. As an alternative, core 2 can also be attached to valve sleeve 6 with a spot weld or a peripheral weld.

In addition to restoring spring 25, an adjusting element in the form of an adjusting spring 29 is also inserted into a flow hole 28 of core 2 running concentric to longitudinal axis 10 of the valve and serving to supply fuel in the direction of valve seat face 16. Adjusting spring 29 is provided to adjust the spring bias of restoring spring 25, which is in contact with adjusting spring 29 and, in turn, is supported at its opposite end on valve needle 14, with the dynamic spray volume also being adjusted with adjusting spring 29. Instead of an adjusting spring, the adjusting element may also be designed as an adjusting screw, an adjusting sleeve or the like.

The injection valve described so far is characterized by an especially compact design, forming a very small, convenient injection valve. These parts form an independent, preassembled module which is labeled as function part 30 below. Function part 30 therefore includes electromagnetic circuit 1, 2, 5 and a sealing valve (valve closing body 19, valve seating body 15) with a downstream jet processing element (spray perforated disk 21).

The coil space formed between valve jacket 5 and valve sleeve 6 and almost completely filled by magnet coil 1 is bordered in the direction facing valve seating body 15 by a stepped radial area 32 of valve jacket 5, while the closure on the side facing away from valve seating body 15 is guaranteed by a disk-shaped cover element 33. Coil body 3 passes through a recess in cover element 33. Two contact pins 34, for example, made of the same plastic as coil body 3 project in this area. The electric contacting of magnet coil 1 and thus its energization take place through electric contact pins 34.

Completely independently of function part 30, a second module is produced, referred to below as connecting part 40. Connecting part 40 is characterized mainly by the fact that it includes the electric and hydraulic connection of the fuel injector. Connecting part 40, which is designed mostly as a plastic part, therefore has a tubular base body 42 to serve as the fuel inlet connection. A fuel filter 45, for example, is inserted or pressed into a flow hole 43 in an inside tube 44 in base body 42 running concentrically to longitudinal axis 10 of the valve, fuel flowing axially through flow hole 43 from the inlet end of the fuel injector.

When the fuel injector is completely assembled, a hydraulic connection of connecting part 40 and function part 30 is achieved by aligning flow holes 43 and 28 of the two modules so that unhindered flow of fuel is guaranteed. An internal opening 46 in cover element 33 makes it possible to design valve sleeve 6 and thus also core 2 so that both pass through opening 46 and at least valve sleeve 6 definitely extends beyond cover element 33 in the direction of connecting part 40. In the assembly of connecting part 40 on function part 30, a lower end 47 of tube 44 in the projecting part of valve sleeve 6 extends into opening 11 of valve sleeve 6 to increase the stability of the connection. When assembled, base body 42 sits on cover element 33 and the upper end of valve jacket 5, for example.

In addition, two electric contact elements 55 are provided in connecting part 40 and are coated during the plastic injection molding of base body 42 and are then subsequently embedded in the plastic. An electric plug connector 56 which is also produced by injection molding is part of base body 42. At one end, electric contact elements 55 end as exposed contact pins of electric plug connector 56, which can be connected to a corresponding electric connector element (not shown) such as a contact strip for complete electric contacting of the injection valve. On the end opposite plug connector 56, contact elements 55 form an electric connection having corresponding contact pins 34.

Figure 2:
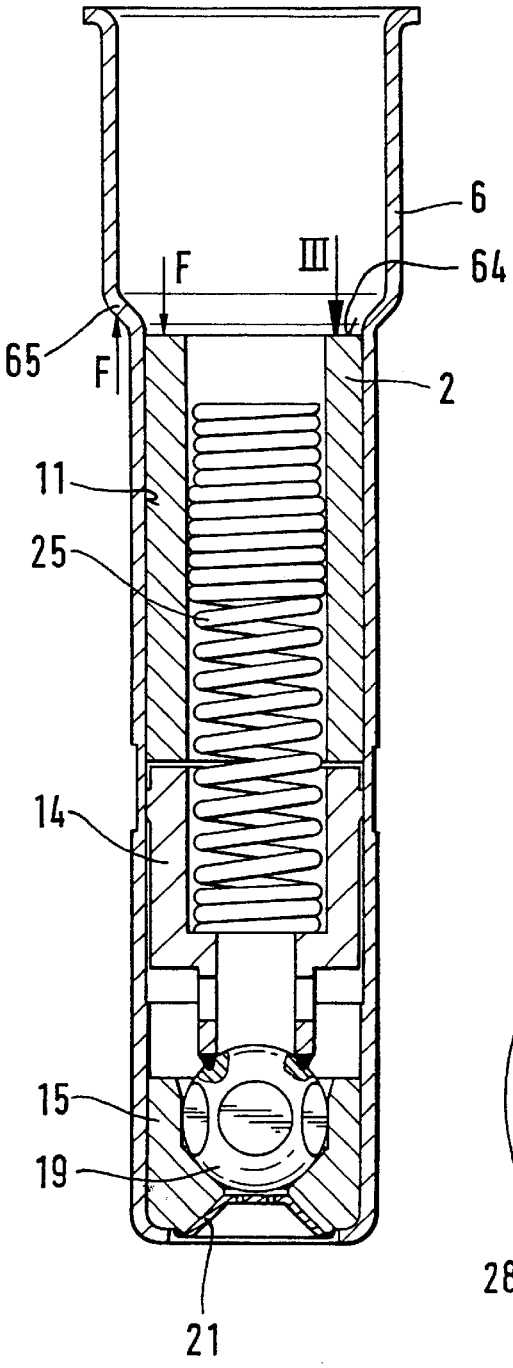
FIG. 2 shows a valve module having an internal pole.

FIG. 2 illustrates a valve module of the entire fuel injector, this valve module being formed by valve sleeve 6 and the fixed and axially movable parts inside valve sleeve 6. As FIG. 2 shows, core 2 is inserted completely into valve sleeve 6, which means that it is surrounded by valve sleeve 6 in the peripheral direction over its entire axial length. Valve sleeve 6, which guarantees a tight seal with the outside, makes it possible to use a core 2 that can be produced by rolling and bending.

Figure 3:
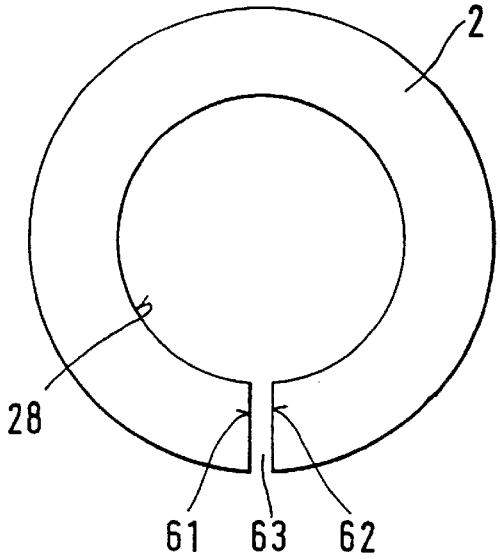
FIG. 3 shows a top view of the internal pole.

Core 2 is made of a metal strip having a uniform thickness according to the present invention, punched out of sheet metal in the form of a quadrilateral shape, in particular a rectangle, according to the required dimensions, and then rolled and/or bent in the desired shape with the help of a mandrel-shaped tool, so that it ultimately has a circular cross section. The two strip ends 61, 62 running in the direction of movement of core 2 form a longitudinal slot 63 having an axial extent because the two ends are opposite one another with a slight distance, as shown in the top view of core 2 in FIG. 3.

A core 2 shaped in this way has several advantages in comparison with the known cores designed as turned parts in fuel injectors. Rolling or bending is a comparatively simple and inexpensive manufacturing method with a relatively low cost for materials. A reduction in eddy currents is achieved through axial longitudinal slot 63 of core 2, thus permitting a higher efficiency of the magnetic circuit.

In addition, assembly of core 2 in valve sleeve 6 and adjustment of the stroke are greatly simplified with the help of core 2. After rolling or bending, core 2 has a slightly larger outside diameter than the diameter of opening 11 in valve sleeve 6. Core 2 is thus under a radial bias from the beginning, making it possible to easily secure core 2 in valve sleeve 6. In addition, because of longitudinal slot 63, the radial dimension of core 2 can be altered slightly, so that burrs are prevented from developing in an advantageous manner when core 2 is inserted into valve sleeve 6. It is equally simple to shift core 2 with an adjusting tool to adjust the stroke of valve needle 14 in valve sleeve 6.

As shown in FIG. 2, it is advantageous to provide a shoulder 65 in valve sleeve 6 close to an upstream end face 64 of core 2. Valve sleeve 6 has a larger diameter upstream from shoulder 65 than downstream from shoulder 65, i.e., in the area where core 2 is inserted into opening 11. In axial displacement of core 2 to adjust the stroke, an adjusting tool acts on core 2 and on valve sleeve 6, for example, so that a force is applied to core 2 in the downstream direction while at the same time a counter-force is applied to shoulder 65 of valve sleeve 6 in the upstream direction, thus establishing a frictional connection between valve sleeve 6 and core 2. Arrows labeled as F in FIG. 2 represent this acting force.

What is claimed is:

1. A method for manufacturing a valve module of a fuel injector for a fuel injection system of an internal combustion engine, comprising:

inserting a valve needle into an opening of a valve sleeve, the valve needle being enclosed by and axially movable along a longitudinal axis of the valve sleeve;

forming an internal pole by one of rolling and bending a metal strip; and inserting the internal pole into the opening in the valve sleeve, wherein the internal pole is fixedly arranged inside the valve sleeve;

wherein the internal pole is inserted into the opening in the valve sleeve so that a shoulder of the valve sleeve is situated close to an upstream end face of the internal pole.

2. The method according to claim 1, wherein the internal pole is formed by one of rolling and bending the metal strip so that the metal strip ultimately has a substantially tubular form.

3. The method according to claim 2, wherein the internal pole is formed by one of rolling and bending the metal strip so that a first strip end and a second strip end of the metal strip run in a direction of movement of the internal pole and are opposite one another forming a longitudinal slot.

4. The method according to claim 1, wherein the internal pole is inserted into the opening in the valve sleeve so that the internal pole is surrounded by the valve sleeve in a peripheral direction over a total axial length of the internal pole.

5. The method according to claim 1, wherein the internal pole is inserted into the opening in the valve sleeve, so that the internal pole is situated downstream from the shoulder, a diameter of the valve sleeve being greater upstream from the shoulder than in the area of the valve sleeve where the internal pole is inserted.

6. The method according to claim 1, wherein the internal pole is inserted into the opening in the valve sleeve so that the path of movement of the valve needle is adjustable by shifting the internal pole.

7. The method according to claim 1, wherein the internal pole is inserted into the opening in the valve sleeve so that the internal pole frictionally engages the valve sleeve.

8. The method according to claim 1, wherein the metal strip has a quadrilateral shape.

9. The method according to claim 8, wherein the quadrilateral shape is punched out from a planar metal sheet having a uniform thickness.

* * * * *